US005895304A

United States Patent [19]

Dixon

[11] Patent Number: 5,895,304

[45] Date of Patent: Apr. 20, 1999

[54] TOY CONSTRUCTOR KIT FOR SAND STRUCTURES

[76] Inventor: Marc Dixon, 1827 17th St., San Pablo, Calif. 94806

[21] Appl. No.: 08/728,193

[22] Filed: Oct. 10, 1996

[51] Int. Cl.[6] ..... A63H 33/32

[52] U.S. Cl. ..... 446/70; 446/85; 446/125; 249/83

[58] Field of Search ..... 446/70, 85, 117, 446/124, 125; 249/55, 83, 90

[56] References Cited

U.S. PATENT DOCUMENTS

| | | | |
|---|---|---|---|
| 468,610 | 2/1892 | Allen | 249/83 |
| 2,549,189 | 4/1951 | Gabo | 446/124 |
| 3,159,899 | 12/1964 | Pefenberg | 249/83 |
| 3,359,677 | 12/1967 | Hepler | 446/70 |
| 4,026,087 | 5/1977 | White | 446/125 |
| 4,346,885 | 8/1982 | Mathou | 446/70 |
| 5,167,843 | 12/1992 | Guillory | 249/83 |
| 5,460,561 | 10/1995 | Dahlgren | 446/70 |

FOREIGN PATENT DOCUMENTS

| | | | |
|---|---|---|---|
| 1192980 | 10/1959 | France | 446/70 |

OTHER PUBLICATIONS

Magic Castle Molds, "Playthings", Feb. 1981, kept in 446/70.

*Primary Examiner*—Robert A. Hafer
*Assistant Examiner*—Jeffrey D. Carlson
*Attorney, Agent, or Firm*—Bielen, Peterson & Lampe

[57] ABSTRACT

A toy construction kit for constructing sand cast structures using a set of different casting molds, support posts installed in the molds during filling and compacting the sand, and support plates that encompass the open part of the mold and that include a socket to engage the post, the support plate and post supporting the sand casting when the mold is removed the kit including interconnection clips to interconnect the support plates of multiple casting when constructing a multi-tier structure.

19 Claims, 2 Drawing Sheets

TOY CONSTRUCTOR KIT FOR SAND STRUCTURES

BACKGROUND OF THE INVENTION

This invention relates to a toy construction kit for building wet sand structures. The toy construction kit includes sets of building modules for casting supportable sand components in making large and elaborate sand structures.

Children enjoy playing in the sand at the beach, or in a playground or home "sandbox." Particular enjoyment is derived from building sand castles and other sand structures from wet or damp sand. Building large or complex sand structures often requires an artistic talent and dexterity not possessed by young children. In fact, such structures are frequently built by young adults, often in teams, during competitions. As the wet sand begins to dry, the sand structure crumbles under its own weight, often before the entire structure is completed.

To provide younger children with the means to produce large, imposing structures in a short period of time, casting pails are frequently used. By packing sand in a sand pail, and inverting the pail at the desired location, elements of a structure can be completed quickly before appreciable drying occurs. While this method is popular with young children, the inability to construct tall and complex structures leads to disinterest and boredom.

In order to provide young children and enthusiastic adults with a challenge in building cast sand structures, the toy construction kit of this invention was devised. The primary problem with the use of existing pail cast structures is the inability to stack castings or span between castings. The toy construction kit of this invention solves the problems of existing sand casting kits that merely provide a series of different molds, and provides structural elements to greatly expand the type and size of structures buildable using the toy construction kit.

The toy construction kit is designed as an educational tool to both develop motor skills and conceptualization. Building integrated structures from a set of modules requires a gradual increase in dexterity as the structures increase in complexity.

The toy construction kit was primarily designed for use with wet sand, but any compactible material, such as snow can be used with the construction kit. In summer or winter, hours of enjoyment can be provided with the toy construction kit of this invention.

SUMMARY OF THE INVENTION

The toy construction kit of this invention relates to a system for building wet sand structures. The system includes, not only a set of sand molds, but additional structural elements that enables the cast sand modules to be stacked and spanned in a variety of different composite structures.

It is contemplated that the toy construction kit can be marketed as a simple starter kit with one or more different mold configurations, and also in more elaborate sets including a variety of different molds. The construction kit includes at least one support plate, a support post connectable to the support plate, and a forming mold into which sand is packed around the support post. The mold may be a simple container similar to the shape of a sand bucket with a post recess for positioning the support post prior to filling with sand. Once sand is filled in the mold, the support plate having a similar post recess is connected to the distal end of the support post which has a length equal to the depth of the container. With the support plate engaged on the support post, the mold is inverted and the support disengaged from the recess in the mold to assist in maintaining the integrity of the sand module which may be lifted by the support plate and located as desired in the structure being built.

In addition to the three basic components, small connecting clips are provided to interconnect a plurality of sand modules by interconnecting the support plates supporting the sand casting. The support clips comprise a small tab with a plurality of short projecting posts that selectively engage one of a series of complementary post recesses in the perimeter of the support plate. In some embodiments an interconnecting plate may be employed to substitute for one or more support clips.

It can be appreciated that although only a single mold need be provided for each casting shape, a plurality of complimentary support plates and support posts are provided to enable the casting mold to produce a plurality of sand modules.

In the preferred embodiments, a plurality of different mold configurations is shown as examples of the type of variety of geometrically-shaped, mold configurations that may be provided with the construction kit, and is not intended to limit the invention to the specific mold configurations shown. As it is intended that a number of sand cast modules be stacked in a spanning fashion, the construction kit in general includes both a support plate for the top as well as the bottom of the cast sand module. In this manner, the weight of the sand module is directed from the base plate of one module to the top plate of the underlying module and hence to the centrally positioned support post. This prevents the weight of other modules from crumbling the sand casting of the lower modules. These and other features will become clear from a consideration of the Detailed Description of the Preferred Embodiments that follows.

DETAILED DESCRIPTION OF THE PREFERRED EMBODIMENTS

Figure 2:
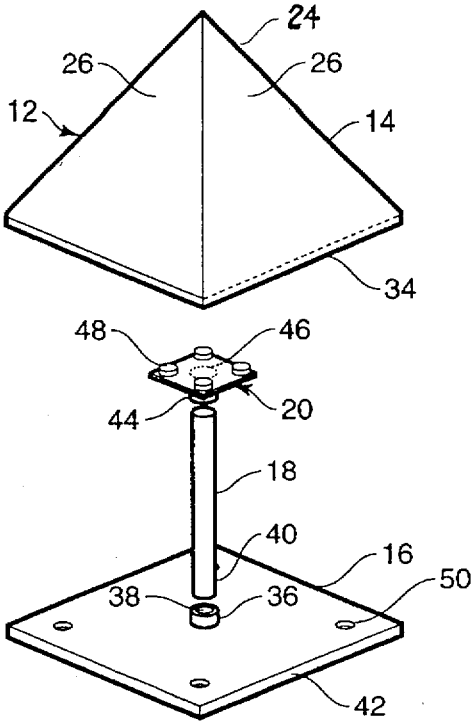
FIG. 2 is a partially exploded view of a kit module with a pyramid-shaped mold for making mold castings used in the structure of FIG. 1.
Figure 1:
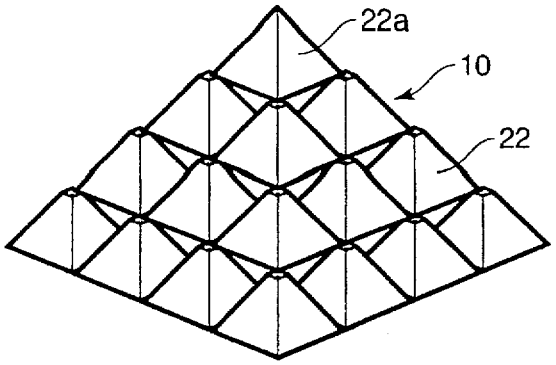
FIG. 1 is a perspective view of a sand structure constructed with the sand casting kit of this invention.
Figure 3:
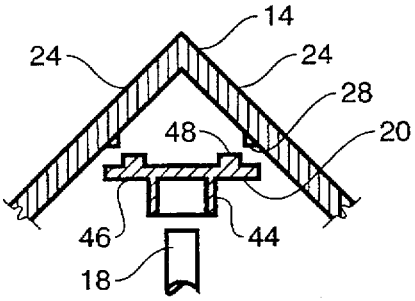
FIG. 3 is an enlarged, partial cross-sectional view of the pyramid-shaped mold of FIG. 2, taken on the lines 3—3 in FIG. 3.
Figure 4:
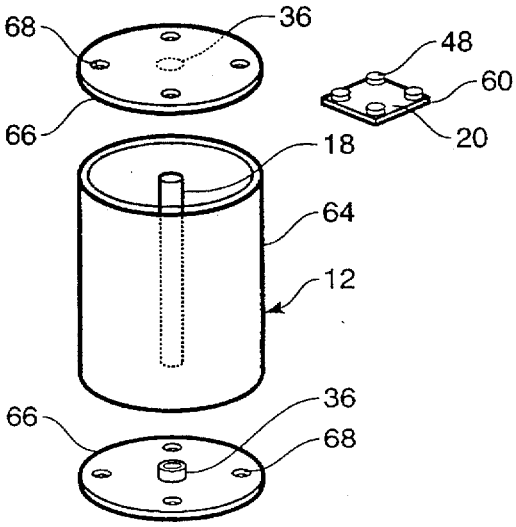
FIG. 4 is an exploded perspective view of a kit module with a bucket-shaped mold.

The toy construction kit for sand structures of this invention may take many different configurations. FIG. 1 shows an example of one type of structure that can be built by one of the molds in the construction kit. The multi-tier pyramid structure, designated generally by the reference numeral 10, is made with a four-sided, truncated pyramid module set 12 as shown in FIG. 2. With reference to FIGS. 1–3, the pyramid module set 12 includes a sand mold 14, a plurality of square support plates 16, a plurality of support posts 18 and a plurality of caps 20. For convenience, only one support plate, post and cap is shown in FIG. 2. A sufficient number of these elements should be provided to construct complex structures as shown in FIG. 1. It is to be understood that different sand castings made from molds of different configurations can be combined into an integrated structure. For simplicity of description, the structure 10 of FIG. 1 incorporates a plurality of pyramid sand castings 22 that are formed by casting with the mold 14 shown in FIG. 2.

The pyramid mold 14 in FIG. 2 has an apex 24 with an internal construction as shown in FIG. 3. The pyramid mold 14 is fabricated with four substantially triangular plates 26 that are interconnected along opposed edges with a small inside projection 28 positioned in each corner at the apex 24. The projection 28 seats a cap 20 and support post 18 when inverted for filling with sand when the casting is intended to support other castings. The top casting **22*a* is made without the cap 20**.

In fabricating a sand casting from the pyramid module set 12 of FIG. 2, the pyramid mold 14 is inverted and the post 18 and cap 20 are positioned on the apex projections 28. Wet or damp sand is then packed in the inverted mold around the support post 18 flush with the perimeter edges 34 of the open pyramid mold 14. It is to be understood that other compactible materials such as snow may be utilized. The support plate 16 has a centrally positioned socket member 36 with a recess 38 to receive the distal end 40 of the support post 18. While the filled mold 14 is inverted, the support plate 16 is oriented to direct the recess 38 of the socket member 36 at the distal end 40 of the installed support post 18. While orienting the edges 42 of the support plate 16 in alignment with the perimeter edges 34 of the pyramid mold 14 that define the opening of the mold, the support plate 16 is pressed against the support post 18 to engage the distal end 40 of the support post 18 with the socket member 36 of the support plate.

When the sand-packed mold 14 is returned to a right-side position and the mold 14 removed from the support plate 16, the support post 18 and cap 20 form an integral part of the sand casting. The support plate 16 is sufficiently rigid to support the sand casting and enable the casting to be lifted and moved to a desired location by the builder. It is to be understood that the opening for release of the sand casting is equal or greater than the internal cross dimension to enable release of the casting.

When the builder constructs a multi-tiered structure as shown in FIG. 1, the top cap 20 remains installed on the distal end 40 of the support post 18. The top cap 20 has a socket portion 44 and a plate portion 46. The plate portion 46 has four short corner pegs 48 that are sized to engage one of the corner holes or dimples 50 in each of a group of plates, enabling the structure 10 as shown in FIG. 1 to be constructed with substantial stability. The top casting **22*a* is made without using the cap 20 by filling the apex portion above the projections 28 with sand. The post 18 is positioned on the sand and centered while the rest of the mold is filled with sand as described above. As noted, the structure of FIG. 1 is constructed using a single mold and a plurality of plate, post and cap members. Other configurations of a mold are shown with reference to FIGS. 4–8**, and the sand castings can be combined and integrated into a variety of different sand structures.

Figure 5:
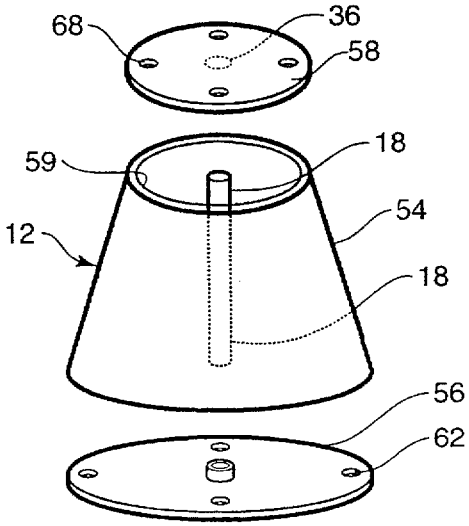
FIG. 5 is an exploded perspective view of a kit module with a cylinder-shaped mold.

Referring to FIG. 5, a mold 54 having the traditional configuration of a common sand pail, is in the form of a truncated cone. In a similar manner, the module set 12 has a circular base plate 56 and a circular top plate 58. Both the base plate 56 and top plate 58 have a centrally positioned socket member 36 which engages a support post 18, as previously described. Again, in use, the conical mold 54 is inverted and the top plate 58 deposited in the bottom 59 of the mold. The support post 18 is installed in the socket member 36 in the top plate 58. Sand is packed into the mold around the post 18 and the base plate 56 pressed against the sand to engage the socket member 36 with the distal end 40 of the post. The mold is then inverted and the casting drops from the mold with the top plate 58 for placement in a desired structure.

Small interconnector members 60, similar in construction to the caps 20, but without a socket member, are provided for interconnecting multiple castings. The interconnection member 60 is square in configuration with a small projecting corner peg 48 in the four topside and bottom side corners. The corner pegs engage holes or dimples 62 spaced around the perimeter of the base plate 56 and the top plate 58.

As a further variation in a module set, the cylindrical module set 12 of FIG. 5 includes a cylindrical open end mold 64. Identical circular end plates 66 each have a central socket member 36 that engages the end of a support post 18. The inside circumference of the cylindrical mold 64 encompasses the perimeter of one of the circular plates 66 with a centrally mounted post 18. Sand is then packed into the cylindrical mold around the support post until filled. When filled, the opposite end plate 66 is centered and the socket member 36 pressed into engagement with the end of the support post 18. Holding the second attached end plate 66, the mold is drawn upward over the mold plate to expose the cylindrical plug-type casting. The end plates 66 have holes 68 for engaging the interconnector members 60 when composite structures are built.

Figure 6:
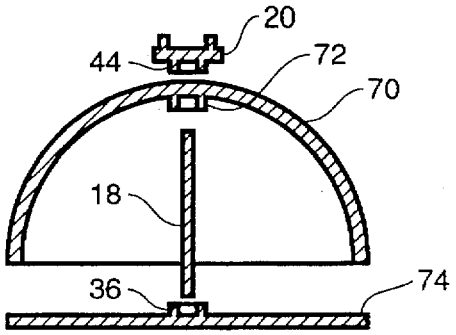
FIG. 6 is an exploded cross-sectional view of a kit module with a hemispherical-shaped mold.
Figure 7:
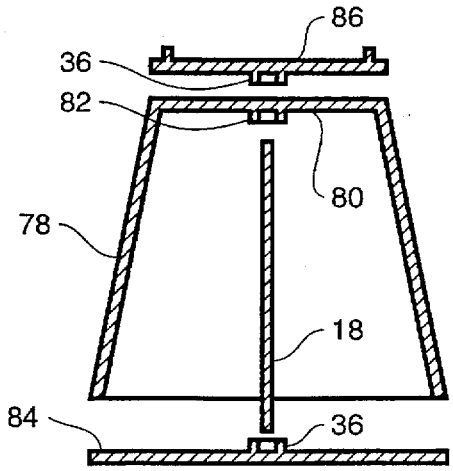
FIG. 7 is an exploded cross-sectional view of a kit module with a truncated pyramid-shaped mold.
Figure 8:
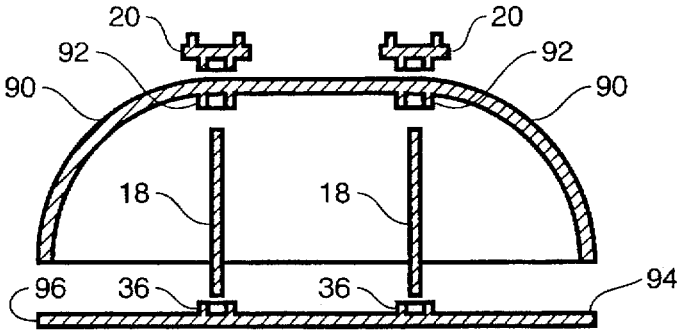
FIG. 8 is an exploded cross-sectional view of a kit module with a hanger-like mold.

Referring to the cross sectional views of FIGS. 6–8, various other configurations of mold structures can form the basis of a module set 12. In FIG. 6, a hemispherical mold 70 has a internal socket 72 for temporarily retaining a support post 18 when packing sand in the mold 70. A circular base plate 74 has a standard socket 36 that engages the post 18 after the mold 70 has been filled with sand and inverted. In return to the placement position, the mold 70 can be removed and a cap 20 with a socket 44 as disclosed with reference to FIG. 2 may be installed on the post 18 for coupling other mold castings. Similarly, in FIG. 7, a truncated pyramidal mold 78 has a bottom 80 with a socket 82 for temporarily and loosely engaging the post 18 when the mold is inverted and filled with sand. A square base plate 84 having a socket 36 that engages post 18 for supporting the casting when the mold is returned to the casting position and removed from the sand casting. A square top plate 86 with a socket 36 engageable with the post 18 may be installed for support of other castings.

Additionally, in FIG. 8 an elongated hangar-like mold 90 having two internal sockets 92 for temporarily holding posts 18 while the mold is inverted and packed with sand. Again, a bottom plate 94 having semi-circular ends 96 with sockets 36 is pressed against the sand filled mold to engage the sockets 36 with the posts 18 for supporting the sand casting. When inverted and the mold 90 is removed, a pair of caps 20 may be installed on the ends of the posts 18 for interconnection of auxiliary castings in the formation of a composite structure.

Figure 9:
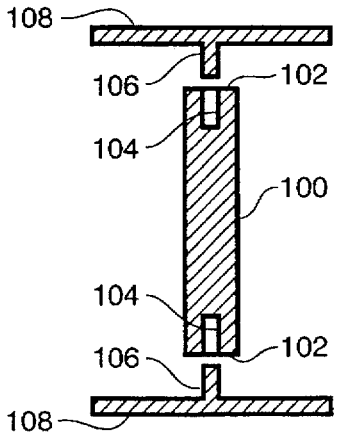
FIG. 9 is an exploded cross-sectional view of an alternate post and plate arrangement.

It is to be understood that if desired, that the socket and post construction can be altered, for example as shown in FIG. 9, wherein the post 100 has ends 102 with a bore 104 that receive a pin 106 mounted on top and bottom support plates 108.

While, in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A toy construction kit for constructing casting structures from compactible material comprising:

at least one invertible casting mold having a defined module shape configured to contain a compactible material, the casting mold having an opening for filling the casting mold with compactible material;

at least one support post having a first end and a second end, the toy construction kit having support means for supporting the first end of said at least one support post in the casting mold when a compactible material is filled and compacted in the casting mold through the casting mold opening;

at least one support plate having engagement means for engaging the second end of the support post, wherein the support plate encloses the opening of the casting mold after a compactible material is filled and compacted in the casting mold and supports a casting structure of compactible material when the casting mold is inverted and removed from the casting structure and support plate;

wherein the kit includes a plurality of support posts and support plates for constructing multiple castings, and wherein the kit includes a plurality of post caps having interconnection means for interconnecting support plates of multiple castings, the post caps each having engagement means for engaging the cap with the first end of a support post supported in a casting mold.

2. The toy construction kit of claim 1 wherein the kit includes a plurality of casting molds, each mold having a different shape.

3. The toy construction kit of claim 1 wherein the kit includes a casting mold having a pyramidal configuration.

4. The toy construction kit of claim 1 wherein the kit includes a casting mold having a cylindrical configuration.

5. The toy construction kit of claim 1 wherein the kit includes a casting mold having a truncated, conical configuration.

6. The toy construction kit of claim 1 wherein the kit includes a casting molding having a truncated, pyramidal configuration.

7. The toy construction kit of claim 1 wherein the kit includes a casting mold having a hemispherical configuration.

8. The toy construction kit of claim 1 wherein the kit includes a casting mold having a hanger-like configuration.

9. The toy construction kit of claim 1 wherein the kit includes a casting mold with a geometrical configuration with an interior cross dimension and an opening dimension no less than the interior dimension.

10. The toy construction kit of claim 1 wherein the engagement means of the support plate comprises a socket.

11. The toy construction kit of claim 1 wherein the engagement means of the post cap comprises a socket.

12. The toy construction kit of claim 1 wherein the caps have perimeter pegs and the interconnection plates have perimeter holes engageable with the perimeter pegs of the caps.

13. A toy construction kit for constructing casting structures from compactible material comprising:

at least one invertible casting mold having a defined module shape configured to contain a compactible material, the casting mold having an opening for filling the casting mold with compactible material;

at least one support post having a first end and a second end, the toy construction kit having support means for supporting the first end of said at least one support post in the casting mold when a compactible material is filled and compacted in the casting mold through the casting mold opening;

at least one support plate having engagement means for engaging the second end of the support post, wherein the support plate encloses the opening of the casting mold after a compactible material is filled and compacted in the casting mold and supports a casting structure of compactible material when the casting mold is inverted and removed from the casting structure and support plate wherein the kit includes a plurality of support posts and support plates for constructing multiple castings, and wherein the kit includes a plurality of additional interconnection plates having interconnection means for interconnecting support plates of multiple castings, the interconnection plates each having engagement means for engaging the interconnection plate with the first end of a support post supported in a casting mold.

14. The toy construction kit of claim 13 wherein the kit includes a plurality of casting molds, each mold having a different shape.

15. The toy construction kit of claim 13 wherein the kit includes a casting mold with a geometrical configuration with an interior cross dimension and an opening dimension no less than the interior dimension.

16. The toy construction kit of claim 13 wherein the engagement means of the support plate comprises a socket.

17. The toy construction kit of claim 13 wherein the kit includes a plurality of post caps having interconnection means for interconnecting support plates of multiple castings, the post caps each having engagement means for engaging the cap with the first end of a support post supported in a casting mold.

18. The toy construction kit of claim 17 wherein the caps have perimeter pegs and the interconnection plates have perimeter holes engageable with the perimeter pegs of the caps.

19. The toy construction kit of claim 17 wherein the engagement means of the post cap comprises a socket.

* * * * *